US007001203B2

(12) United States Patent
Morishita

(10) Patent No.: US 7,001,203 B2
(45) Date of Patent: Feb. 21, 2006

(54) PIERCING TERMINAL FOR COAXIAL CABLE

(75) Inventor: Yoshimasa Morishita, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/991,874

(22) Filed: Nov. 19, 2004

(65) Prior Publication Data

US 2005/0130484 A1 Jun. 16, 2005

(30) Foreign Application Priority Data

Nov. 21, 2003 (JP) ..... 2003-393020
Dec. 3, 2003 (JP) ..... 2003-404848

(51) Int. Cl.
*H01R 11/20* (2006.01)

(52) U.S. Cl. ..... 439/409; 439/394

(58) Field of Classification Search ..... 439/409, 439/389, 394, 395, 396
See application file for complete search history.

(56) References Cited

U.S. PATENT DOCUMENTS

| | | | | |
|---|---|---|---|---|
| 4,533,191 | A * | 8/1985 | Blackwood | 439/174 |
| 4,708,414 | A * | 11/1987 | Lam | 439/394 |
| 5,076,800 | A * | 12/1991 | Milnes et al. | 439/394 |
| 5,154,632 | A * | 10/1992 | Ijiri | 439/394 |
| 6,206,720 | B1 * | 3/2001 | Larkin et al. | 439/395 |
| 6,379,198 | B1 * | 4/2002 | Arnett et al. | 439/825 |
| 6,475,019 | B1 * | 11/2002 | Zielke et al. | 439/404 |
| 6,524,127 | B1 * | 2/2003 | Turek et al. | 439/404 |
| 6,799,988 | B1 * | 10/2004 | Mansur | 439/404 |
| 2003/0104723 | A1 * | 6/2003 | Laub et al. | 439/585 |

FOREIGN PATENT DOCUMENTS

| | | |
|---|---|---|
| DE | 200 01 912 U1 | 7/2001 |
| EP | 0 369 767 | 5/1990 |
| EP | 0 419 038 | 3/1991 |
| EP | 0 647 985 | 4/1995 |
| JP | 2001-223039 A | 8/2001 |
| JP | 2003-077567 A | 3/2003 |

(Continued)

OTHER PUBLICATIONS

European Search Report, Appln. No. 04027327.8-2214-, dated Mar. 14, 2005.

*Primary Examiner*—Chandrika Prasad
(74) *Attorney, Agent, or Firm*—Rader, Fishman & Grauer PLLC

(57) ABSTRACT

A piercing terminal for a coaxial cable composed of a core conductor wire, an inner insulating layer for covering the core conductor wire, an outer conductor-shielding layer for covering the inner insulating layer, and an outer insulating layer for covering the outer conductor-shielding layer, which can electrically connected with the outer conductor-shielding layer when a pair of piercing blades of the piercing terminal is embedded into the outer insulating layer to penetrate the outer insulating layer. The piercing terminal includes: a pair of strips spaced apart at a distance larger than the outer diameter of the core conductor wire and smaller than that of the inner insulating layer and opposed substantially in parallel; a piercing blade formed in the leading end of each strip; and a pair of curved portions outwardly convex with respect to the pair of strips near to the base portion thereof. The piercing terminal can reduce the difference of the impedance between the core conductor wire and piercing terminal and the impedance between the core conductor wire and outer conductor-shielding when electrically connected with the coaxial cable.

8 Claims, 18 Drawing Sheets

FOREIGN PATENT DOCUMENTS

| | | | |
|---|---|---|---|
| JP | 2003-077568 | A | 3/2003 |
| JP | 2003-115339 | A | 4/2003 |
| JP | 2003-115340 | A | 4/2003 |
| JP | 2003-168497 | A | 6/2003 |
| JP | 2003-203697 | A | 7/2003 |
| JP | 2003-203701 | A | 7/2003 |
| JP | 2003-203702 | A | 7/2003 |
| JP | 2003-243060 | A | 8/2003 |
| JP | 2003-249280 | A | 9/2003 |
| JP | 2003-264012 | A | 9/2003 |
| JP | 2003-264013 | A | 9/2003 |
| JP | 2003-317819 | A | 11/2003 |

* cited by examiner

PIERCING TERMINAL FOR COAXIAL CABLE

CROSS-REFERENCE TO RELATED APPLICATIONS

This application is based upon and claims the benefits of priorities from Japanese Patent Application Nos. 2003-393020 and 2003-404848 filed on Nov. 21, 2003 and Dec. 3, 2003, respectively, the entire contents of which are incorporated herein by reference.

This application is related to a co-pending U.S. patent application entitled "PRESSURE CONNECTION STRUCTURE WITH COAXIAL CABLE" and being filed on even date herewith. The co-pending application is expressly incorporated herein by reference.

FIELD OF THE INVENTION

The present invention relates to a piercing terminal for a coaxial cable. More specifically, it relates to a piercing terminal suitable for inserting a piercing blade into a coaxial cable to make a conductive connection with an outer conductor-shielding layer.

RELATED ART

In regard to conventional piercing terminals, there have been known ones used such that an electric wire composed of a core wire constituted by stranded thin conducting wires and an insulating material for covering the core wire is stabbed with a piercing blade of a piercing terminal thereby to establish a conductive connection between the piercing terminal and core wire (see e.g. JP-A-2003-168497, and JP-A-2003-264013).

Also, there has been known a piercing terminal used to establish a conductive connection with a coaxial cable (see e.g. JP-A-2001-223039). FIG. 18 is a view showing a situation where such piercing terminal is press-connected to an outer conductor-plexus-shielding layer of a coaxial cable. FIG. 18 hereof corresponds to FIG. 12 of JP-A-2001-223039. As shown in FIG. 18, the coaxial cable 150 is composed of: a core conductor wire 151; an inner insulating layer 152 for covering the core conductor wire 151; a cancellate outer conductor-plexus-shielding layer 153 composed of knitted conducting wire for covering the inner insulating layer 152; and an outer insulating layer 154 for covering the outer conductor-plexus-shielding layer 153. Further as shown in FIG. 18, the coaxial cable 150 is locationally adjusted so that a pair of cuspidated portions 101 never comes into contact with the core conductor wire 151 when the U-shaped piercing terminal 100 is embedded into the coaxial cable 150. The pair of needle-like cuspidated portions 101 are embedded and penetrate into the outer insulating layer 154, outer conductor-plexus-shielding layer 153, and inner insulating layer 152 sequentially, whereby a conductive connection between the piercing terminal 100 and outer conductor-plexus-shielding layer 153 is established.

However, in the case of a piercing terminal disclosed by JP-A-2001-223039, when the distance L between the core conductor wire 151 and the outer conductor-plexus-shielding layer 153 is compared with the distance L1 between the core conductor wire 151 and the piercing terminal 100 in a conductive connection with the outer conductor-plexus-shielding layer 153, it is shown that L and L1 are in the relation L>L1, as shown in FIG. 18. As a result, the impedance between the core conductor wire 151 and the outer conductor-plexus-shielding layer 153 varies along an axial direction of the coaxial cable 150.

Likewise, it is conceivable that the impedance variations are developed even when a piercing terminal disclosed by JP-A-2003-168497 or JP-A-2003-264013 is applied for making a connection with a coaxial cable, because the coaxial cable and core conductor wire are round in section and a piercing blade of the piercing terminal (which is equivalent to the aforementioned cuspidated portion for piercing a coaxial cable) is in a linear shape.

SUMMARY OF THE INVENTION

According to an aspect of the invention, the impedance variation between the core conductor wire and outer conductor-shielding layer of a coaxial cable in the axial direction thereof can be less developed when the piercing terminal is brought into a conductive connection with the coaxial cable.

Therefore, the invention provides a piercing terminal arranged as described below and a connection structure for the piercing terminal.

A piercing terminal for a coaxial cable including a core conductor wire, an inner insulating layer for covering the core conductor wire, an outer conductor-shielding layer for covering the inner insulating layer, and an outer insulating layer for covering the outer conductor-shielding layer, wherein the piercing terminal is capable of performing a conductive connection with the outer conductor-shielding layer when a piercing blade is embedded in the outer insulating layer to penetrate the outer insulating layer, the piercing terminal comprising: a pair of clipping pieces being arranged to be opposed to each other in a substantially parallel manner; the piercing blade being disposed at a leading end of each of said pair of clipping pieces; and a coupling portion being joined to base portions of said pair of clipping pieces for holding said pair of clipping pieces spaced at a predetermined distance apart, wherein each of said pair of clipping pieces comprises a curved portion which is curved outwardly with respect to the pair of clipping pieces, the curved portion being disposed in a vicinity of the base portion and between the piercing blade and the base portion; wherein the predetermined distance is larger than an outer diameter of the core conductor wire and smaller than an outer diameter of the inner insulating layer; wherein the piercing blade at the leading end of each of said pair of clipping pieces is provided with a sharp edge such that the piercing blade pierces the outer insulating layer; and wherein the respective curved portions of said pair of clipping pieces wrap the inner insulating layer around the outer diameter thereof so as to hold the coaxial cable when said pair of piercing blades pierce the outer insulating layer to penetrate the outer insulating layer and the coaxial cable is pressed down between said pair of clipping pieces with the predetermined distance apart to bring the piercing terminal into a conductive connection with the outer conductor-shielding layer.

The piercing terminal includes a pair of clipping pieces arranged substantially in parallel with each other and spaced apart at a distance larger than the outer diameter of the core conductor wire and smaller than the outer diameter of the inner insulating layer and piercing blades provided at the leading ends of the pair of clipping pieces. Also, the piercing terminal includes curved portions formed in outwardly convex forms with respect to the pair of clipping pieces, in respective vicinities of the base portions of the pair of clipping pieces. In the condition where the distance between the curved portions and the core conductor wire is substantially identical with the distance between the outer conductor-shielding layer and core conductor wire, the coaxial cable and the piercing terminal can be held in an electrical connection and as such, the impedance between the core conductor wire and the curved portions is made substantially equivalent to the impedance between the core conductor wire and the outer conductor-shielding layer. As a result, impedance variations in an axial direction of the coaxial cable are less prone to being developed.

In addition, it is possible to increase the rigidity of the pair of clipping pieces which are made easily deformable due to the curved portions formed in the pair of clipping pieces even in the case where the pair of clipping pieces of the above-described piercing terminal is formed from a thinner metal plate. With the above-described piercing terminal, in the case where the pair of clipping pieces are formed from a thin metal plate, an insertion force of the pair of clipping pieces may cause the curved portions to be bent when the pair of clipping pieces is embedded and penetrates into the outer conductor-shielding layer. In other words, the pair of clipping pieces may be swerved deviating from their intended direction for penetration and then the curved portions may be stressed locally or generally by the insertion force. As a result, the curved portions may be deformed before the pair of clipping pieces are embedded and penetrate into the outer conductor-shielding layer, thereby changing the direction for piercing and insertion of the pair of clipping pieces. This may make it more difficult to insert the pair of clipping pieces and may cause the pair of clipping pieces to be inserted in a wrong direction thereby to short-circuited with respect to the core conductor wire.

Therefore, the pair of clipping pieces may include reinforcing ribs extending from the curved portions toward the leading ends of the clipping pieces. As a result, the rigidity of the clipping pieces can be increased in order to prevent the aforementioned bend of the pair of clipping pieces due to the formation of the curved portions when the clipping piece are embedded and penetrate into the outer insulating layer.

The edges of said piercing blades may be disposed closer to the outside of the pair of clipping pieces in the thickness direction of each clipping piece. For example, the piercing terminal may be characterized in that the leading end portions of the piercing blades are chamfered on an outer side with respect to the pair of clipping pieces thereby to provide the edges of the pair of piercing blades on the inside in the thickness direction.

In the case where the edges of the pair of piercing blades are provided in this way, when the edges are embedded and penetrate into the outer insulating layer, their tapered faces work so that the insertion force causes a force to press the pair of clipping pieces inwardly with respect to the pair of clipping pieces. Therefore, it becomes possible to prevent the distance between the pair of clipping pieces from being widened when the pair of clipping pieces are embedded and penetrate into the outer insulating layer.

In addition, the form defined by inner surfaces of the curved portions provided in the respective pair of clipping pieces arranged opposite to each other may be a cylindrical form which allows the curved portions to be located on a concentric circle of the coaxial cable to enwrap the cable. In this case, the inner diameter of the cylindrical form defined by the inner surfaces of the curved portions may coincide with the inner diameter of the outer conductor-shielding layer.

The above arrangement can keep constant the distance between the core conductor wire of the coaxial cable and the pair of clipping pieces and the distance between the core conductor wire and outer conductor-shielding layer. Therefore, the invention can provide a piercing terminal which can be connected so that no impedance variations are developed in an axial direction of the coaxial cable.

Further features of the invention, its nature, and various advantages will be more apparent from the accompanying drawings and the following detailed description of the invention.

DESCRIPTION OF THE PREFERRED EMBODIMENT

An embodiment of the invention will be described below in reference to the drawings. However, the invention is not limited to the embodiment, and various modifications and changed in design may be made.

Piercing Terminal

Figure 1:
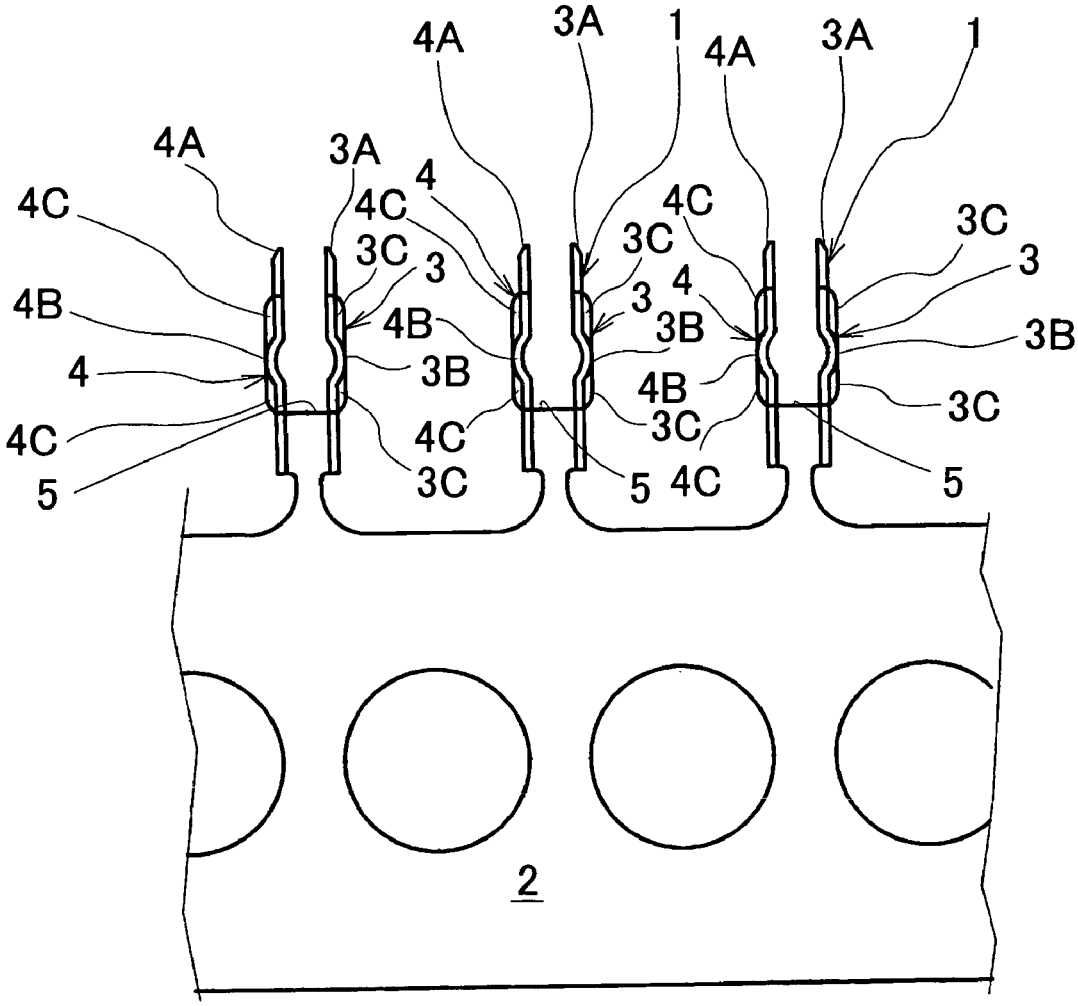
FIG. 1 is a front view showing a plurality of piercing terminals coupled in series (in the form of a hoop) through a common member in a manufacturing step.
Figure 2:
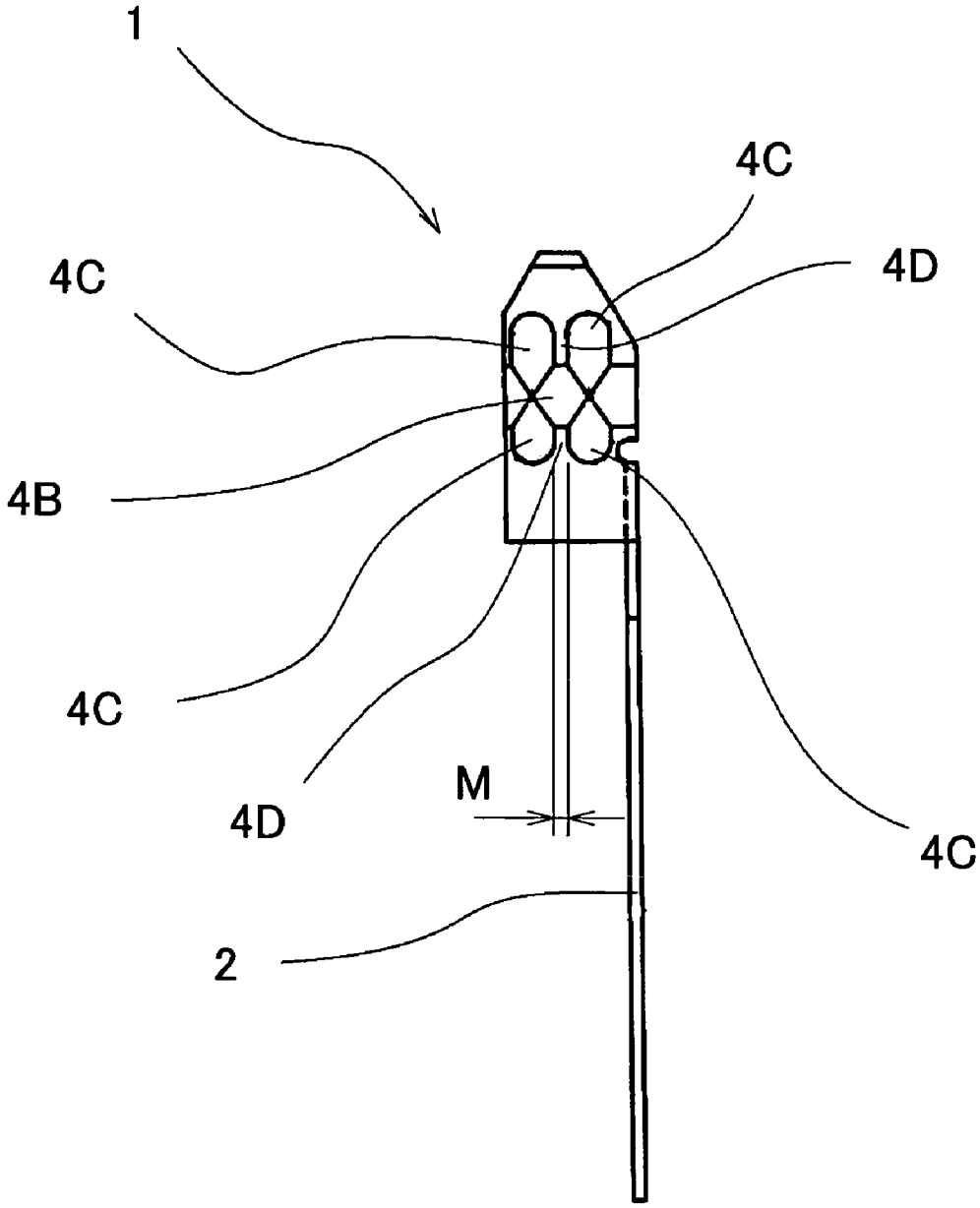
FIG. 2 is a side view of the coupled piercing terminals illustrated in FIG. 1.
Figure 3:
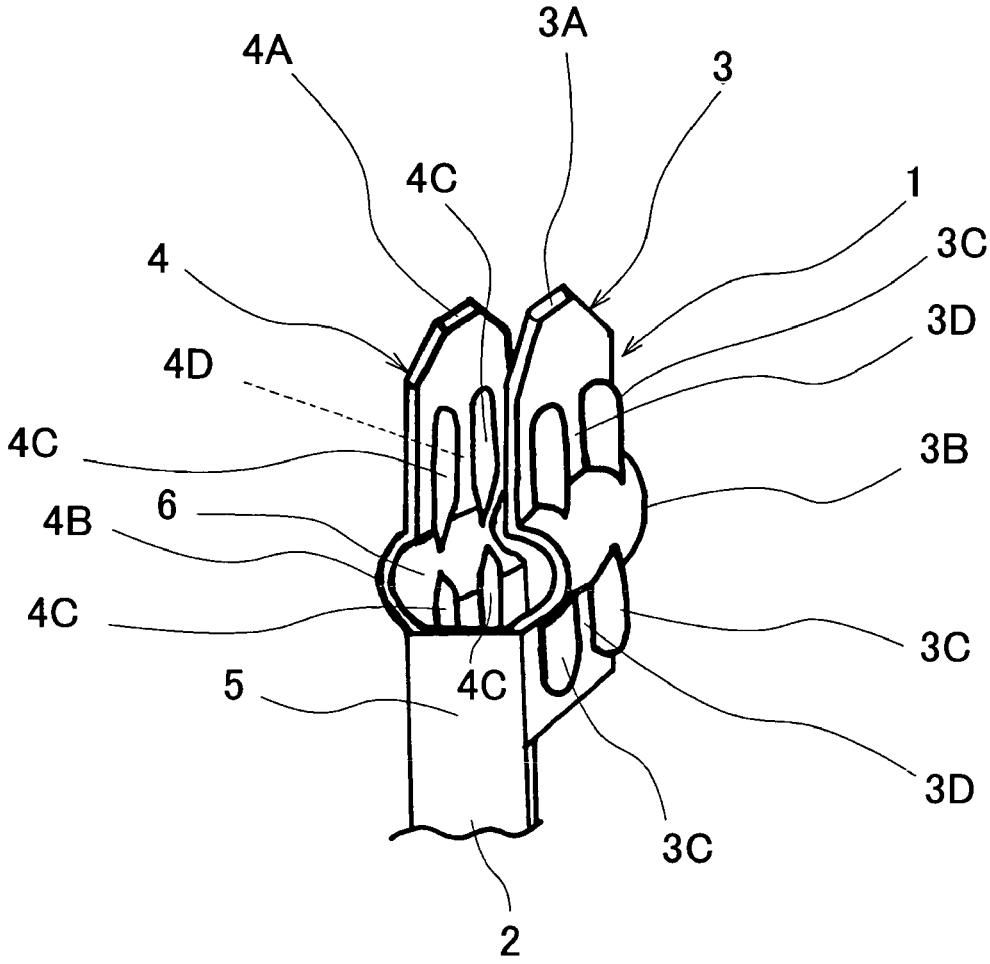
FIG. 3 is a partial perspective view of the coupled piercing terminals illustrated in FIG. 1.

An arrangement of a piercing terminal according to the invention will be described in reference to FIGS. 1–3. FIG. 1 is a front view showing a plurality of piercing terminals coupled in series (in the form of a hoop) through a common member in a manufacturing step. FIG. 2 is a side view of the coupled piercing terminals illustrated in FIG. 1. FIG. 3 is a partial perspective view of the coupled piercing terminals illustrated in FIG. 1.

The piercing terminals 1 are formed into a form as shown in FIG. 1 by performing cutting, stamping, etc. with respect to a belt-shaped, thin conductive metal sheet, in which the piercing terminals 1 are coupled through a common member 2 at predetermined intervals in series.

Then, the piercing terminals 1 illustrated in FIGS. 1–3 are press-inserted into a first housing part 10 from outside so that coaxial cables 50 (see FIG. 4, for example) can be held inside a housing constituted by the first housing part 10 and a second housing part 20. As a result of the insertion, the piercing terminals 1 are electrically connected to the coaxial cables 50.

Each of the piercing terminals 1 has a pair of opposed clipping pieces 3, 4, each having a piercing blade for piercing a coaxial cable 50 to insert the clipping pieces therein. The opposed clipping pieces 3, 4 in pairs and the coupling portion 5 for coupling base portions of the clipping pieces 3, 4 generally conform to the form of a horseshoe in top view. The coupling portion 5 and the clipping pieces 3, 4 define an opening 6 for receiving a coaxial cable 50. The opening 6 leads to an accommodation space (a gap between clipping pieces), which is defined by the clipping pieces 3, 4 and is in communication with the outside.

The piercing blades 3A, 4A are formed by chamfering the leading end portions of the respective clipping pieces 3, 4 into tapers (the leading end portions of the clipping pieces are illustrated on the upper portion in FIGS. 1–3). In the rear of each piercing blade 3A (4A), there is provided a curved portion 3B (4B) (illustrated in the lower portion or closer to the base portion thereof in FIGS. 1–3), which extends across the width of the clipping piece 3 (4) (or in a horizontal direction of the clipping piece 3 (4) in FIG. 1) and is formed in an outwardly convex shape with respect to the clipping piece 3 (4).

The formation of the curved portions 3B, 4B may decrease the rigidity of the clipping pieces 3, 4 against the deformation caused by embedding the piercing terminal 1 into a coaxial cable 50. Therefore, the rigidity of the clipping pieces 3, 4 are reinforced by reinforcing ribs 3C, 4C which extend from the respective curved portions 3B, 4B towards the leading ends of the clipping pieces 3, 4 (i.e. the upper ends in the drawing) or towards the rear ends thereof (i.e. the lower end in the drawing) and which arrayed in two rows on outer surfaces of the curved portions 3B, 4B. The reinforcing ribs 3C, 4C are formed as convex portions extending toward the leading and rear ends of the clipping pieces 3, 4 with the curved portions 3B, 4B interposed in the respective clipping pieces 3, 4 by press working. As described above, the reinforcing ribs 3C, 4C are arranged in pairs in parallel with each other respectively on the clipping pieces 3, 4. As a result, each pair of the reinforcing ribs 3C (4C) defines a ground-terminal-receiving groove 3D (4D) therebetween. Into the ground-terminal-receiving grooves 3D, 4D, a pectinated rectangular flat-plate-shaped ground terminal 40, which is to be described later, can be fitted. The ground-terminal-receiving grooves 3D, 4D each have a width of M. The width M is arranged so as to be identical with or smaller than the width of the ground terminal 40 to allow the insertion of the ground terminal 40.

Assembling Structure of Coaxial Cable and Piercing Terminal to Housing

Figure 4:
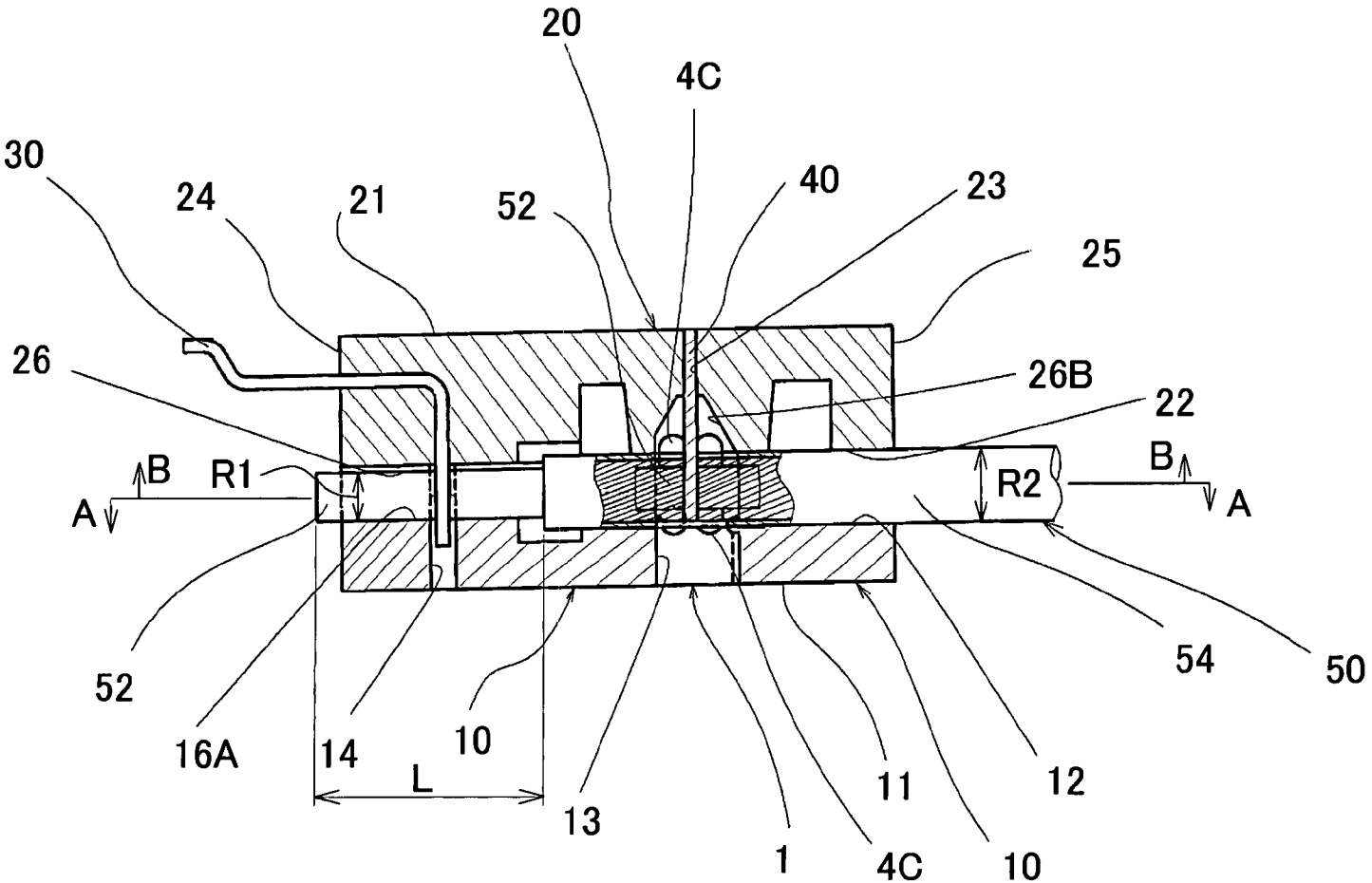
FIG. 4 is a side, longitudinal sectional view showing the condition where the piercing terminal 1, the press-connecting contact 30, the ground terminal 40 and the coaxial cable 50 are incorporated in the housing composed of a first housing part 10 and a second housing part 20.
Figure 5:
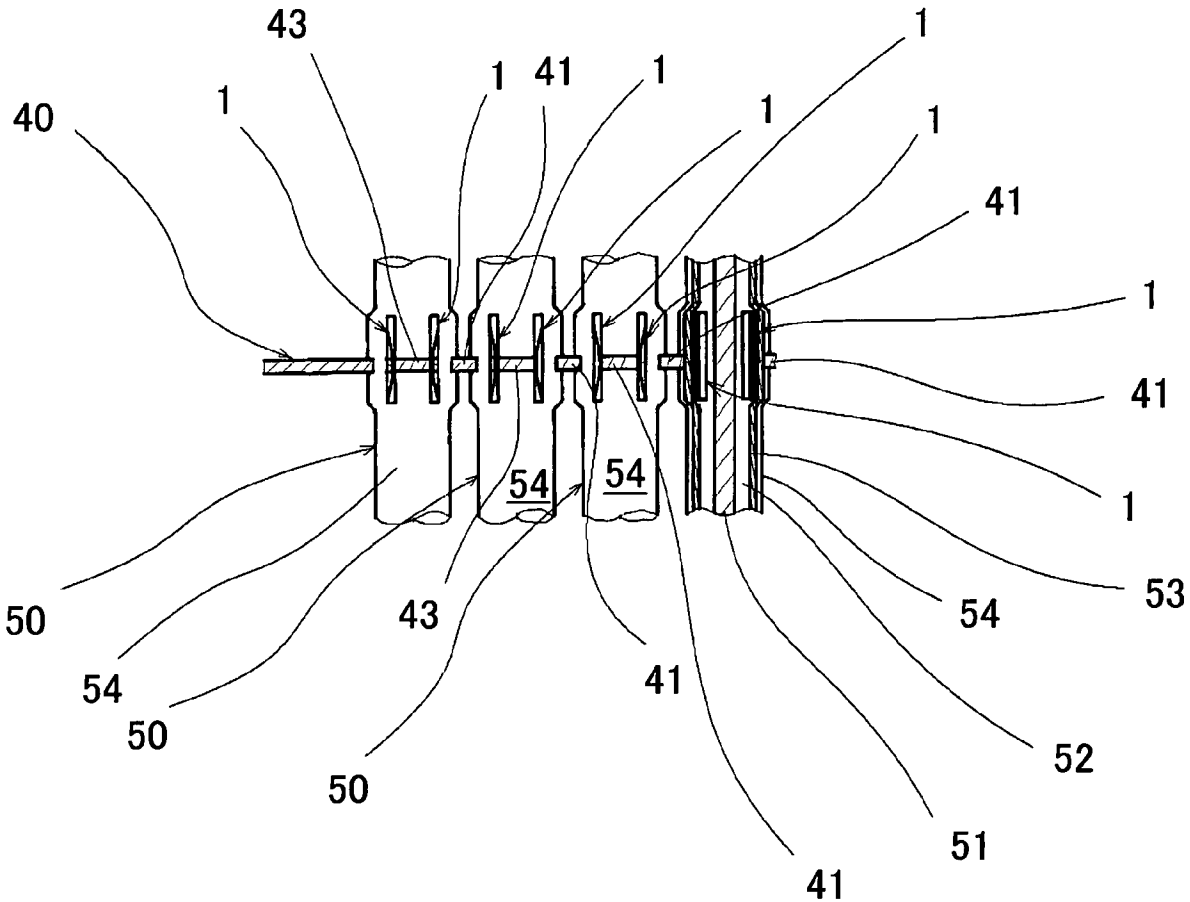
FIG. 5 is a partial sectional view taken along the line A—A in FIG. 4.
Figure 6:
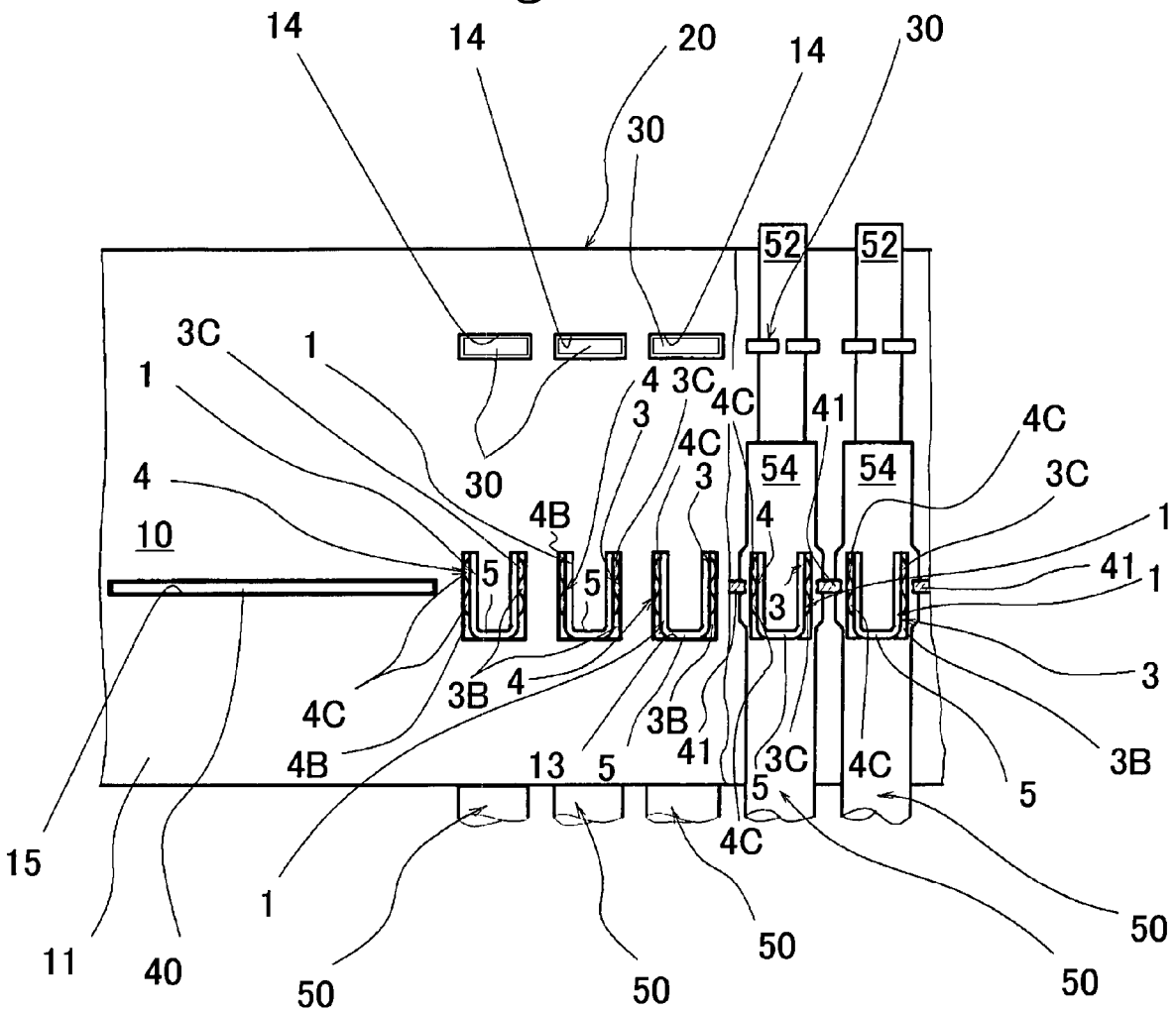
FIG. 6 is a sectional view taken along the line B—B in FIG. 4.
Figure 7:
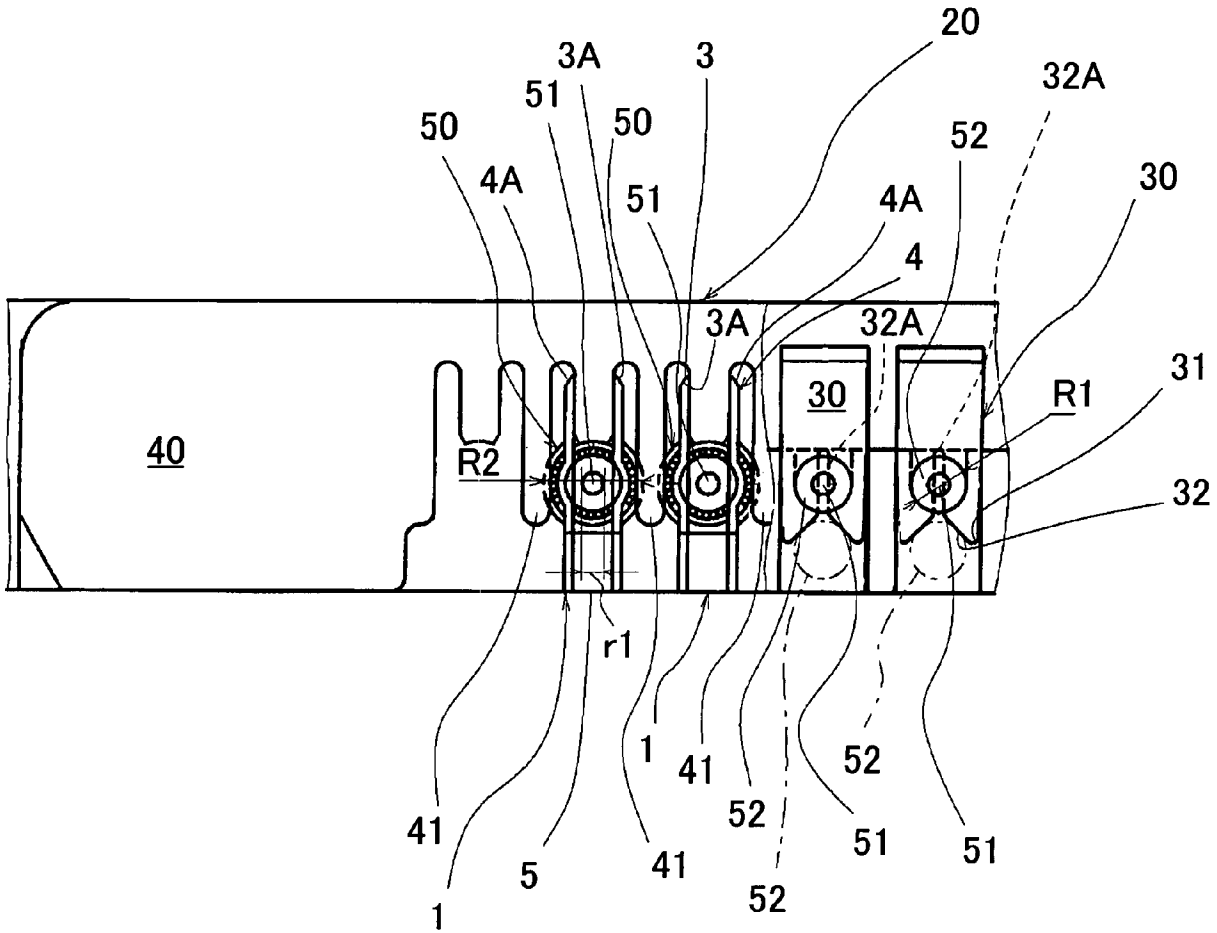
FIG. 7 is a front view of the structure illustrated by FIG. 4.

An assembling structure of the piercing terminal 1 and coaxial cable 50 to a housing will be described in reference to FIGS. 4–7. FIG. 4 is a side, longitudinal sectional view showing the condition where the piercing terminal 1, the press-connecting contact 30, the ground terminal 40 and the coaxial cable 50 are incorporated in the housing composed of a first housing part 10 and a second housing part 20. FIG. 5 is a partial sectional view of the pressure connection structure taken along the line A—A in FIG. 4. FIG. 6 is a sectional view of the pressure connection structure taken along the line B—B in FIG. 4. FIG. 7 is a front view of the pressure connection structure illustrated by FIG. 4.

The first housing part 10 takes a rectangular form in plane view. In the first housing part 10, a plurality of horseshoe-shaped piercing terminal-receptacle holes 13 for the piercing terminals 1 are pierced from the bottom surface 11 to the top surface 12.

The horseshoe-shaped terminal-receptacle holes 13 are provided in a longitudinal direction of the first housing part 10 at predetermined intervals H, while in a location opposite to the location of the horseshoe-shaped piercing terminal-receptacle hole 13 for each piercing terminal 1 in a shorter side direction of the first housing part 10 is formed a contact-receptacle hole 14 for the press-connecting contact 30, penetrating the first housing part 10 from its bottom surface 11 to the top surface 12.

Further, on a prolongation of a straight line segment along which the horseshoe-shaped terminal-receptacle holes 13 are arrayed in parallel, there is formed a ground-terminal-receptacle hole 15 for receiving the pectinated rectangular flat-plate-shaped ground terminal 40 penetrating the first housing part 10 from its top surface 12 to the bottom surface 11.

Meanwhile, the second housing part 20 has a ground-terminal-receptacle hole 23 formed in a location which agrees with the location of the above-described ground-terminal-receptacle hole 15 when the first and second housing parts 10, 20 are assembled up and down; the ground-terminal-receptacle hole 23 penetrates the second housing part from its top surface 21 to the bottom surface 22 and has the same form as the ground-terminal-receptacle hole 15.

Then, in the condition where the coaxial cables 50 are disposed in place on the first housing part 10, the second housing part 20 containing the press-connecting contacts 30 is pressed against the first housing part 10 from above it, while the ground terminals 40 are inserted into the ground-terminal-receptacle holes 23, 15, and the piercing terminals 1 are inserted into the horseshoe-shaped terminal-receptacle holes 13, whereby the piercing terminals 1 are assembled to the housing. In this situation, just embedding the piercing terminal 1 into the coaxial cable 50 can electrically connect the outer conductor-shielding layer of the coaxial cable 50 with the ground terminal 40 through the piercing terminal 1. This is because the first and second housing parts 10, 20 are made from an insulative material. This connection structure is to be described later in detail.

First Housing Part

Figure 8:
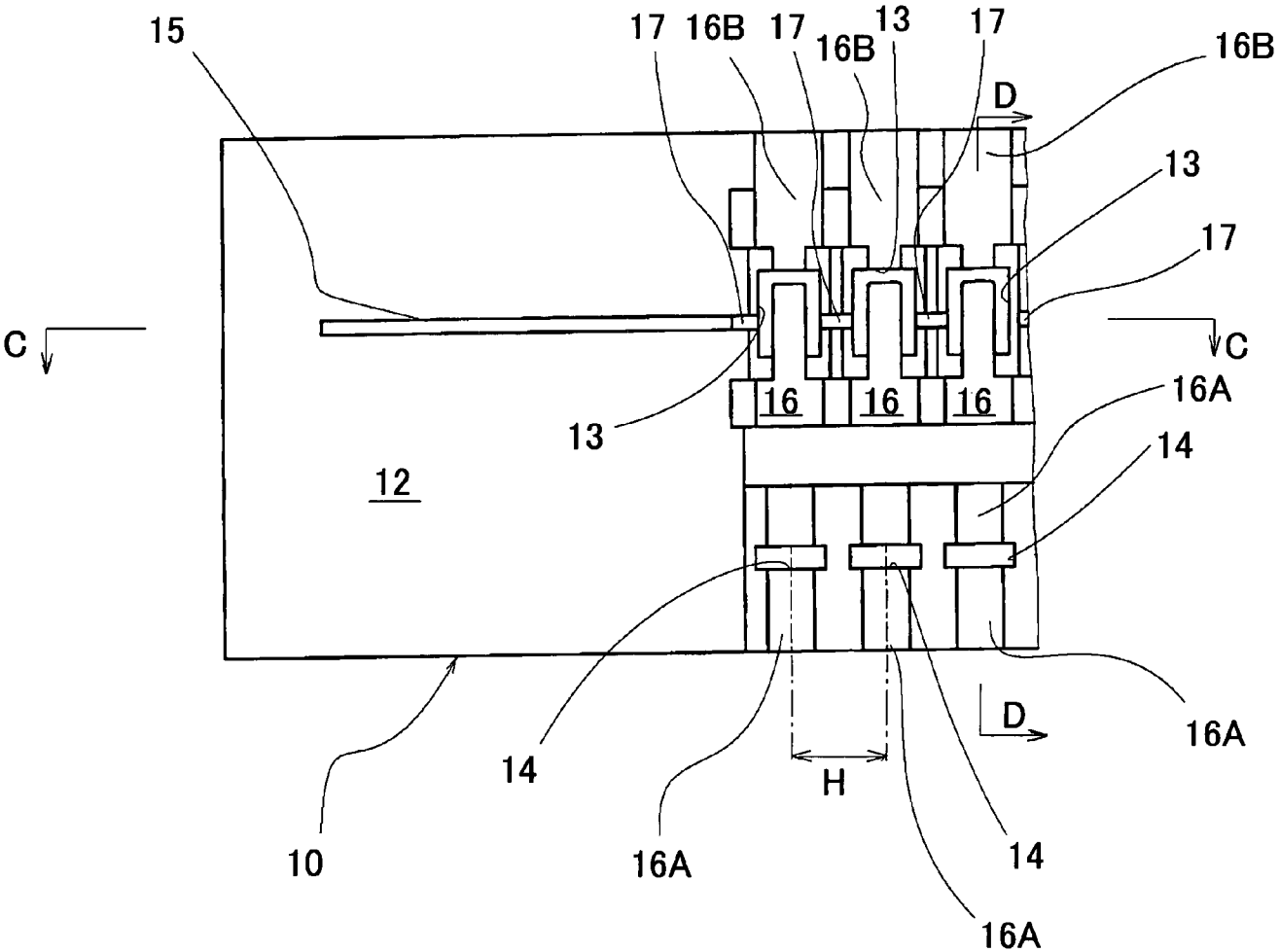
FIG. 8 is a plane view partially broken away of the first housing part 10.
Figure 9:
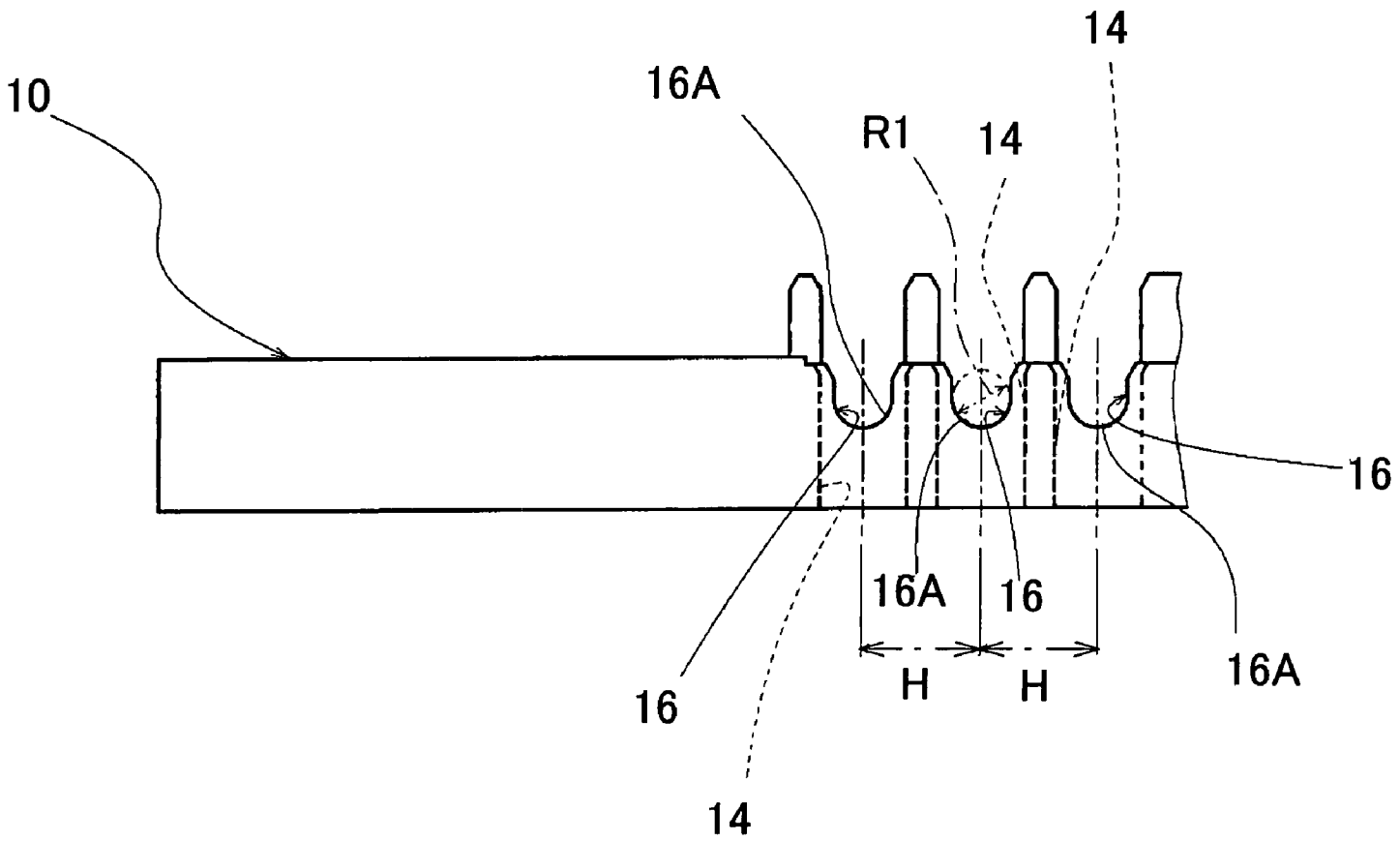
FIG. 9 is a front view of the first housing part illustrated by FIG. 8.
Figure 10:
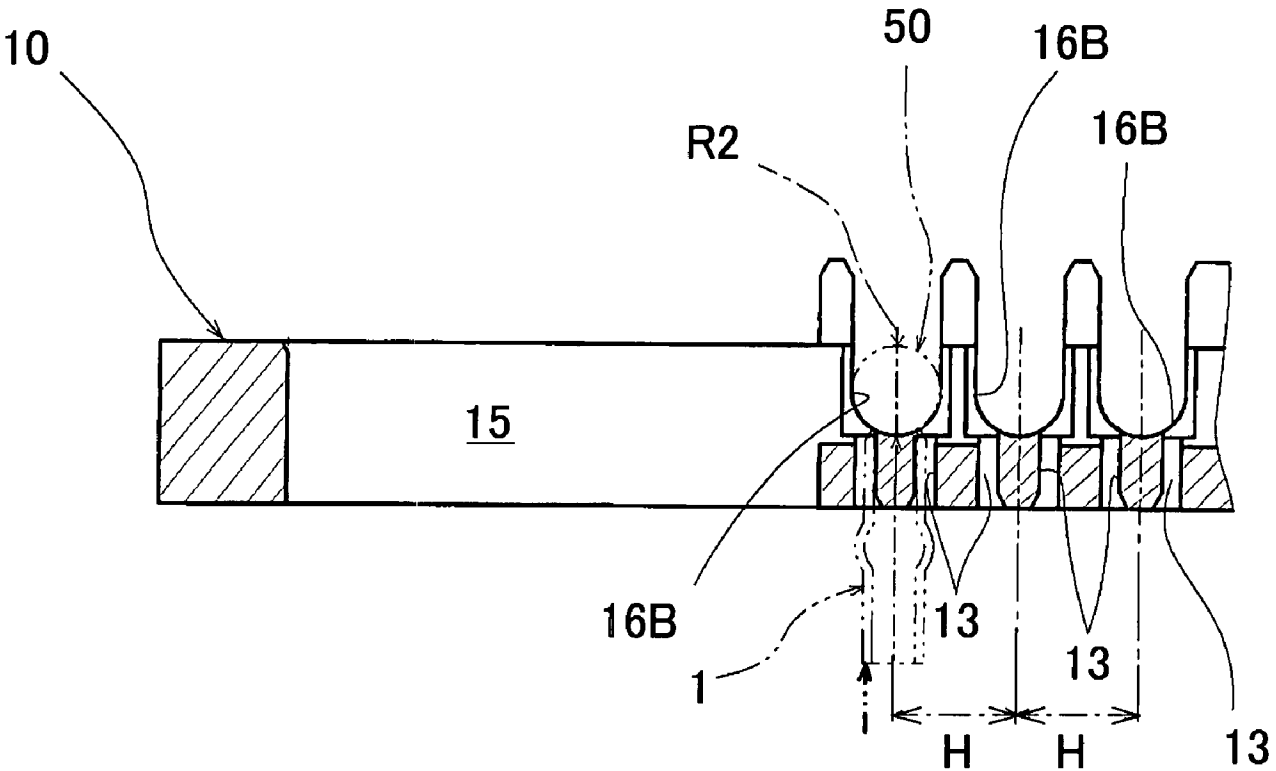
FIG. 10 is a sectional view of the first housing part taken along the line C—C in FIG. 8.
Figure 11:
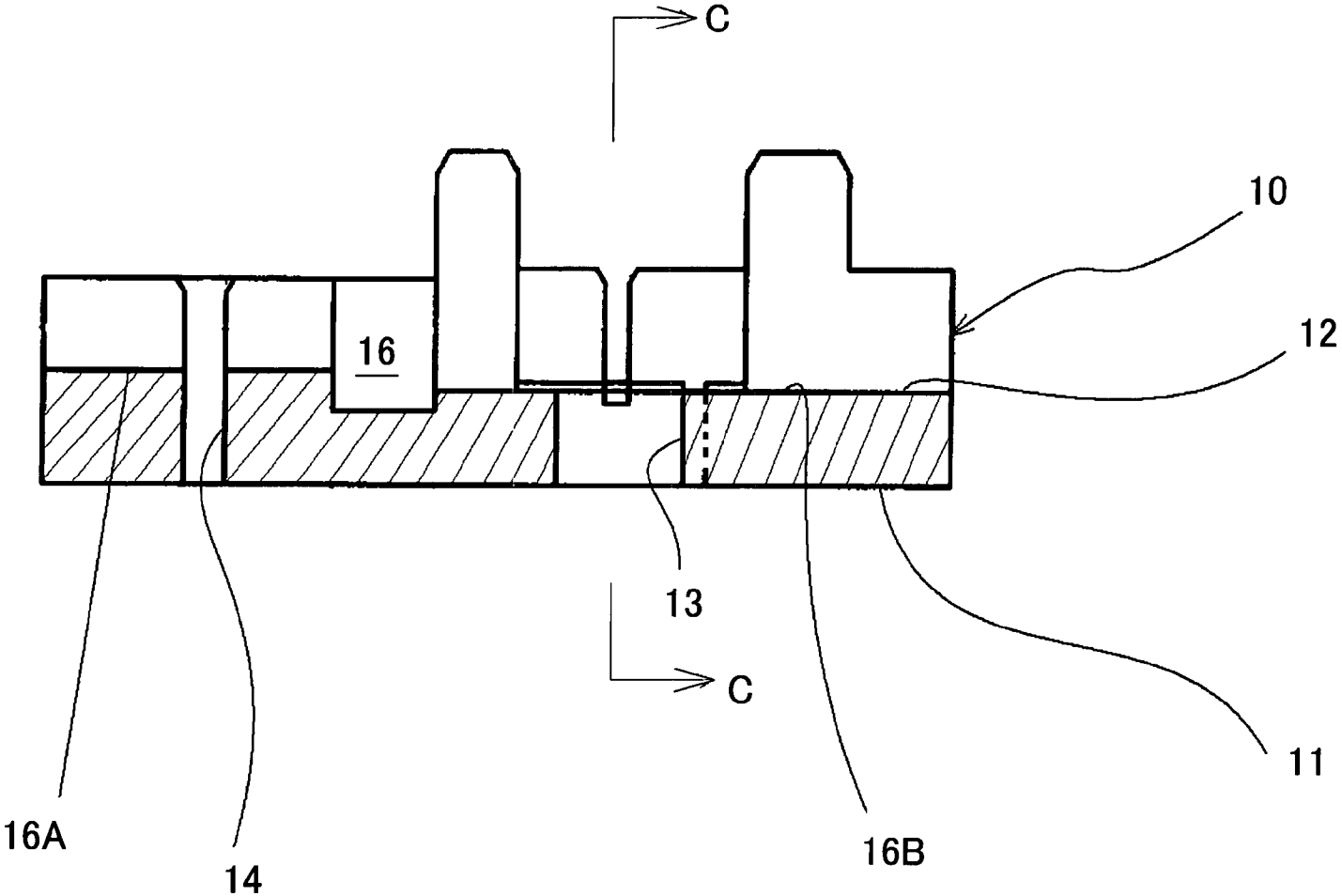
FIG. 11 is a sectional view of the first housing part taken along the line D—D in FIG. 8.

The first housing part 10 will be described here in reference to FIGS. 8–11. FIG. 8 is a plane view partially broken away of the first housing part 10. FIG. 9 is a front view of the first housing part illustrated by FIG. 8. FIG. 10 is a sectional view of the first housing part taken along the line C—C in FIG. 8. FIG. 11 is a sectional view of the first housing part taken along the line D—D in FIG. 8.

The first housing part 10 is composed of an insulative material made by molding of a resin, etc. As described above, the first housing part 10 takes a rectangular form in plane view, and has a plurality of horseshoe-shaped terminal-receptacle holes 13 for piercing terminals 1 pierced therein; the horseshoe-shaped terminal-receptacle holes 13 penetrate the first housing part from its bottom surface 11 to the top surface 12 and are arrayed at predetermined intervals H along a longer side direction of the first housing part 10. In a location opposite to the location of the horseshoe-shaped piercing terminal-receptacle hole 13 for each piercing terminal 1 in a shorter side direction of the first housing part 10 is formed a contact-receptacle hole 14 for the press-connecting contact 30, penetrating the first housing part 10 from its bottom surface 11 to the top surface 12.

Also, the first housing part 10 has a cable-receiving groove 16 for each coaxial cable 50 provided in the top surface 12 thereof astride the horseshoe-shaped piercing terminal-receptacle hole 13 and the contact-receptacle hole 14 opposite to the terminal-receptacle hole 13. The coaxial cable 50 to be placed in the cable-receiving groove 16 may be widely known one, which is composed of a core conductor wire 51, an inner insulating layer 52 for covering the core conductor wire 51, an outer conductor-shielding layer 53 for covering the inner insulating layer 52, and an outer insulating layer 54 for covering the outer conductor-shielding layer 53, as shown in FIG. 4.

At the time when a coaxial cable 50 is placed in the cable-receiving groove 16, the coaxial cable 50 has been preprocessed, thereby having made its outer conductor-shielding layer 53 and outer insulating layer 54 stripped off by a predetermined length of L from its leading end and bared the inner insulating layer 52. Thus, the coaxial cable 50 takes the form of a cable with a shoulder such that the cable has a diameter R1 in a range up to the predetermined length L from its end along its length and has another diameter R2 larger than R1 in the remaining range. According to the geometrical condition, each cable-receiving groove 16 is composed of: a groove 16A arc-shaped in section having the diameter R1; and a groove 16B arc-shaped in section having the diameter R2. Herein, the groove 16A lies in a range of from the leading end of the cable-receiving groove 16 to a distance away from the leading end by a length shorter than L, the range including the contact-receptacle hole 14; and the groove 16B lies in the remaining range, i.e. the range starting from a distance away from the leading end by the length L.

Further, on a prolongation of a straight line segment along which the horseshoe-shaped terminal-receptacle holes 13 are arrayed in parallel, there is formed a ground-terminal-receptacle hole 15 for the pectinated rectangular flat-plate-shaped ground terminal 40 penetrating the first housing part 10 from its top surface 12 to the bottom surface 11. In addition, in the top surface 12 between adjacent horseshoe-shaped terminal-receptacle holes 13, there are individually provided outline-keeping member-receiving grooves 17 each having a predetermined depth for receiving the outline-keeping comb tooth-like member 41 of the ground terminal 40 for keeping the outline of a coaxial cable 50. The distance between the outline-keeping comb tooth-like members 41 is set to be smaller than R2 so as to put the a coaxial cable 50 between the outline-keeping comb tooth-like members 41 and hold it from outside the outer insulating layer 54, i.e. a portion of the cable with the largest diameter.

Ground Terminal

Figure 12A:
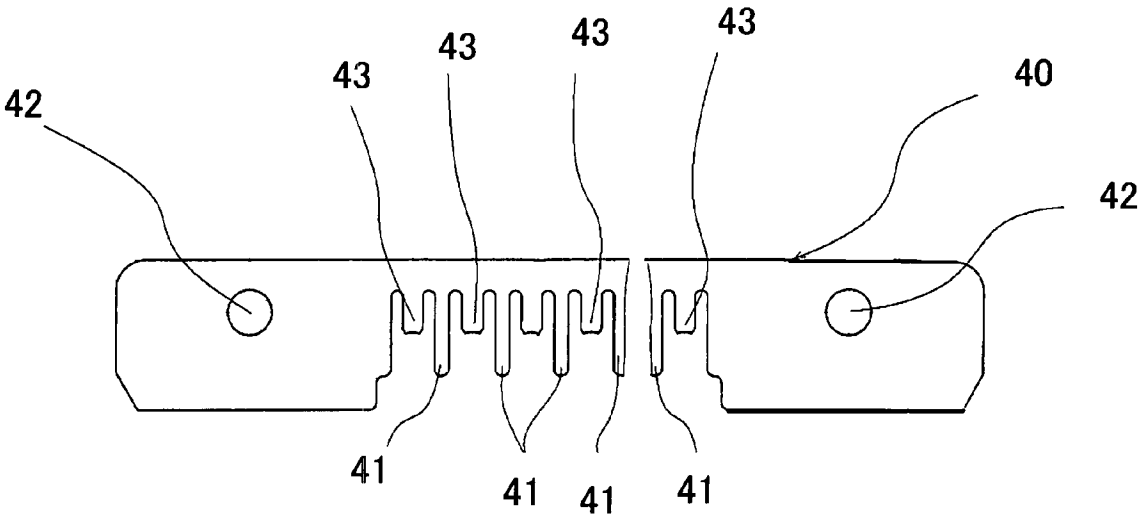
FIG. 12A is a front view of the ground terminal 40.
Figure 12B:
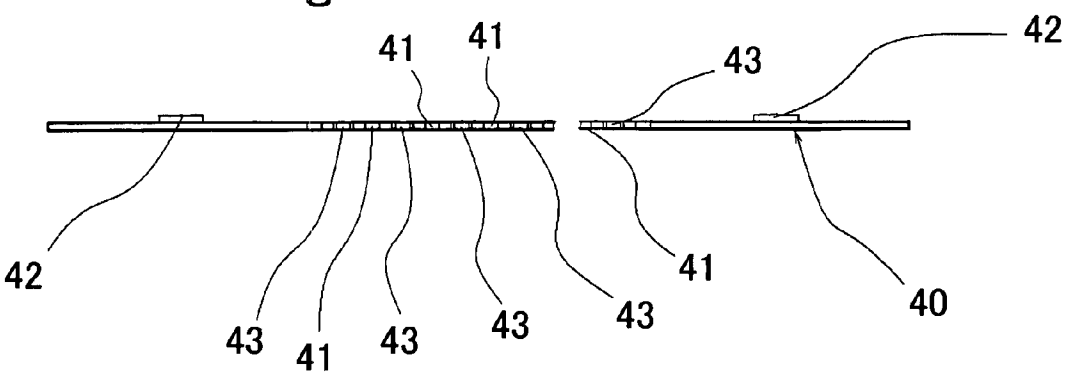
FIG. 12B is a side view of the ground terminal 40.

Now, a configuration of the ground terminal 40 will be described in reference to FIGS. 12A and 12B. FIG. 12A is a front view of the ground terminal 40. FIG. 12B is a side view of the ground terminal 40.

The ground terminal 40 is composed of a thin plate made of a metal having an electrically conducting property, and has ground-terminal-holding protrusions 42 respectively provided in two end portions thereof in its longitudinal direction; the protrusions 42 serve to hold the ground terminal 40 in the ground-terminal-receptacle hole 15 after the ground terminal is forced to fit into the hole 15. The ground-terminal-holding protrusions 42 make the thickness of the ground terminal 40 larger than the width of the ground-terminal-receptacle hole 23. As a result, when the ground terminal 40 is inserted into the ground-terminal-receptacle hole 23, the ground terminal 40 is to be forced to fit into the hole 23 and thus held therein. The ground terminal 40, which can be forced to fit into the hole and held therein in this way, can avoid falling out of the second housing part 20 accidentally.

Further, between the ground-terminal-holding protrusions 42, there are alternately disposed the above-described outline-keeping comb tooth-like members 41. FIG. 7 shows the condition where each coaxial cable 50 is held between the outline-keeping comb tooth-like members 41 from outside a portion of the cable with the largest diameter.

Moreover, between the outline-keeping comb tooth-like members 41 is formed one protruding portion 43, which has a length shorter than that of the outline-keeping members 41 and serves to force down a coaxial cable 50 from outside a portion of the cable with the largest diameter.

Second Housing Part

Figure 13:
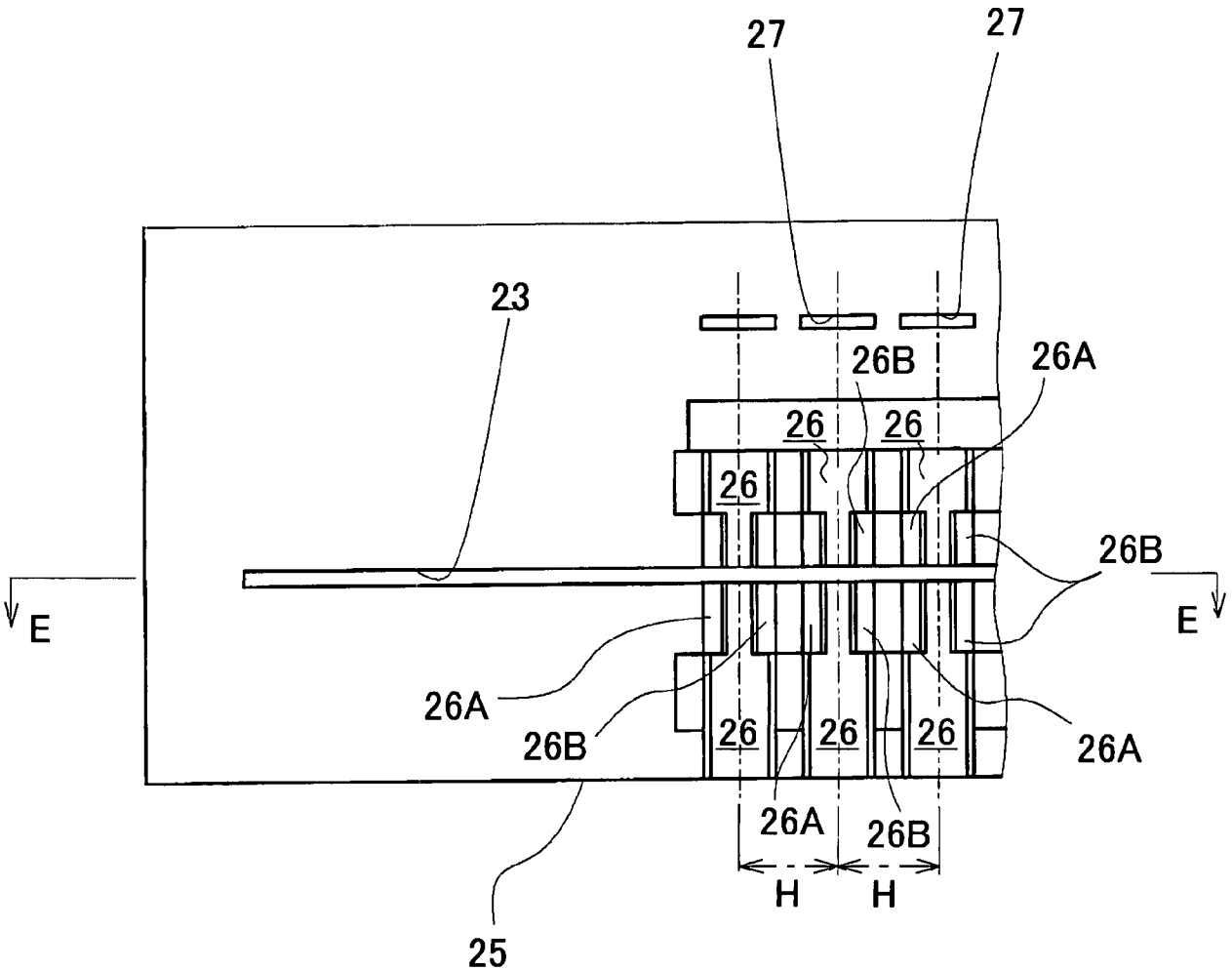
FIG. 13 is a bottom view of the second housing part.
Figure 14:
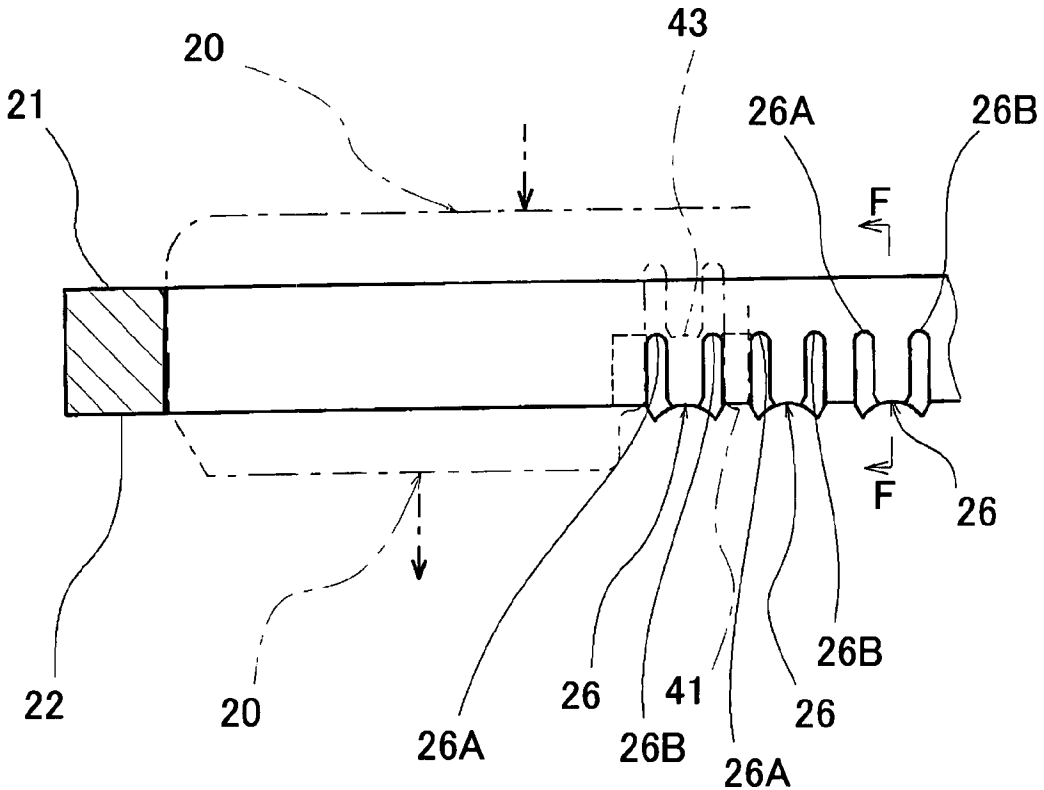
FIG. 14 is a sectional view of the second housing part taken along the line E—E in FIG. 13.
Figure 15:
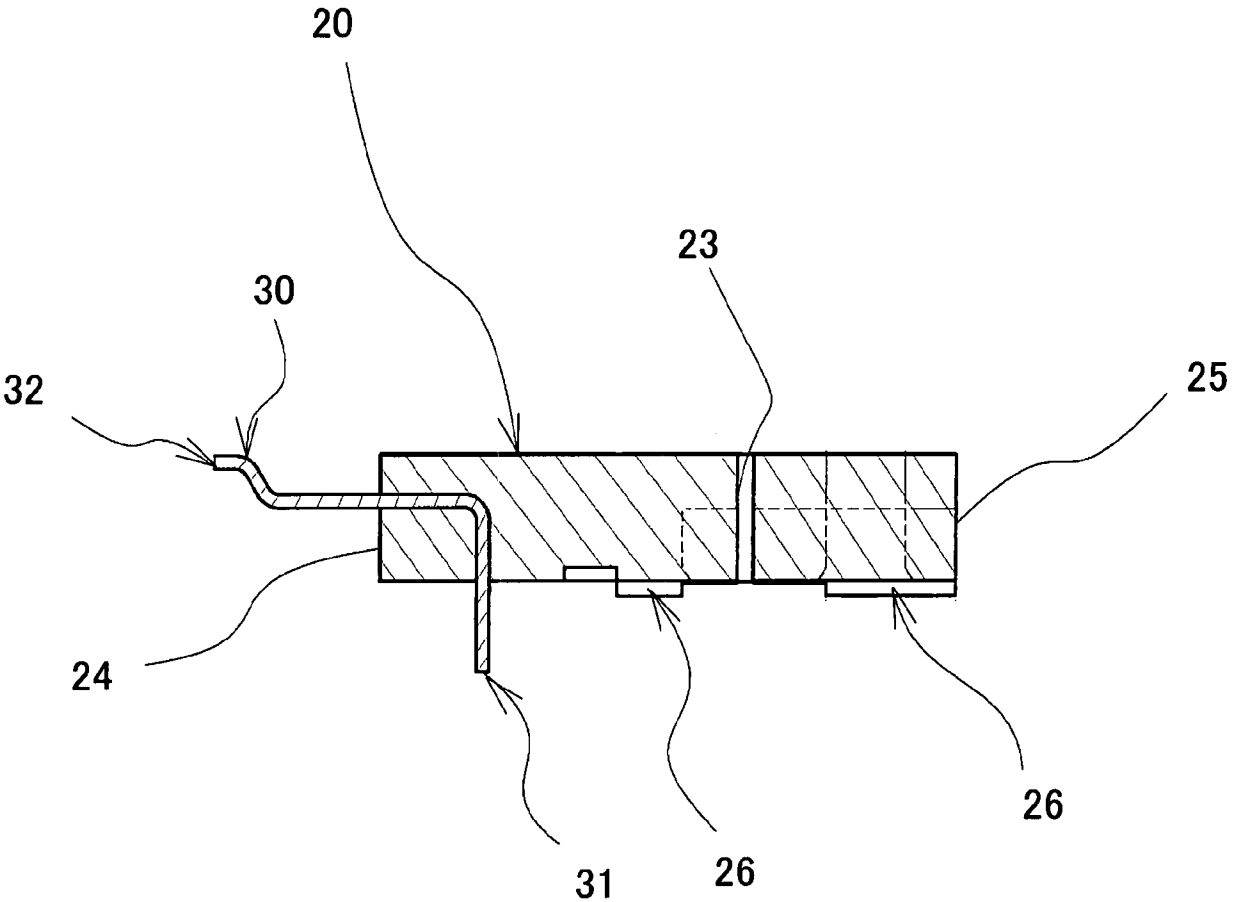
FIG. 15 is a sectional view of the second housing part taken along the line F—F in FIG. 14.

A structure of the second housing part will be described in reference to FIGS. 13–15. FIG. 13 is a bottom view of the second housing part. FIG. 14 is a sectional view of the second housing part taken along the line E—E in FIG. 13. FIG. 15 is a sectional view of the second housing part taken along the line F—F in FIG. 14.

The second housing part 20 is composed of an insulative material made by molding of a resin, etc. In the second housing part 20, the press-connecting contact 30 shaped into a thin rod form is fixed so that its first end 31 is led out from the bottom surface 22 of the second housing part and the second end 32 is led out from a first side 24 of the second housing part 20. The first end 31 of the press-connecting contact 30 is electrically connected to the core conductor wire 51 of a coaxial cable 50, and the second end 32 is electrically connected to a wired circuit on an outer circuit board by soldering or connection under pressure.

Further, the second housing part 20 is provided with a guide groove 26 for placing a coaxial cable 50 thereon, which extends from a second side 25 of the second housing part 20 inwardly, provided that the second side 25 is opposite to the first side 24 from which the press-connecting contact 30 is led out.

In locations in the bottom surface 22 of the second housing part 20 opposed to the location of each horseshoe-shaped piercing terminal-receptacle hole 13 in an up and down direction when the first and second housing parts 10, 20 are assembled up and down, there is formed a pair of grooves 26A, 26B into which the pair of clipping pieces 3, 4 of each piercing terminal 1 are inserted.

In a location in the second housing part 20 near to the first side 24 on a prolongation of a straight line segment along which the guide groove 26 extends and opposite to the location of each contact-receptacle hole 14 in an up and down direction, an opening 27 for leading out the first end 31 of each press-connecting contact 30 is formed.

Press-Connecting Contact

Figure 16A:
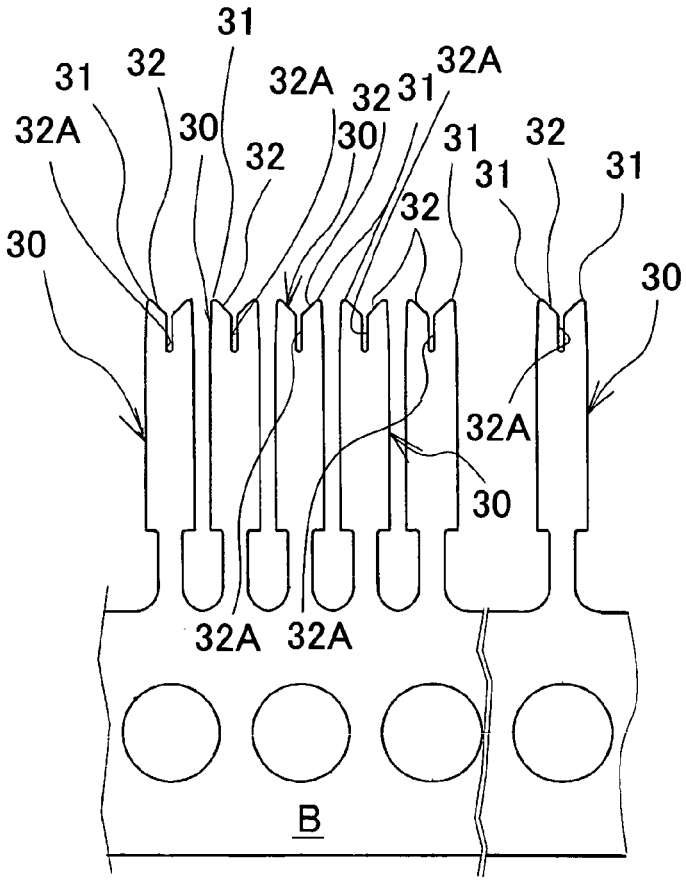
FIG. 16A is a front view showing the condition where a plurality of press-connecting contacts 30 are coupled to a common member B.
Figure 16B:
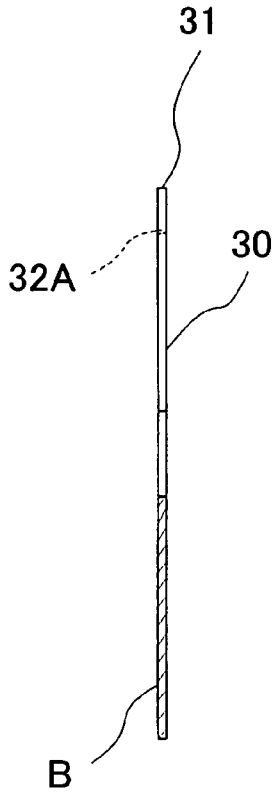
FIG. 16B is a side view showing the condition illustrated by FIG. 16A.

A structure of the press-connecting contact 30 will be described in reference to FIGS. 16A and 16B. FIG. 16A is a front view showing the condition where a plurality of press-connecting contacts 30 are coupled to a common member B. FIG. 16B is a side view showing the condition illustrated by FIG. 16A.

Each press-connecting contact 30 has a press-connecting blade 32 formed in a V-like form in front view in a first end 31 of the contact; the press-connecting blade 32 serves to tear a hole in the inner insulating layer 52 of a coaxial cable 50 thereby to electrically connect the press-connecting contact 30 to the core conductor wire 51 of the coaxial cable 50 when the coaxial cable 50 is pressed against the press-connecting blade 32. In a central portion of the press-connecting blade 32 is formed a press-connecting groove 32A for leading and fixing the core conductor wire 51. Also, the press-connecting groove 32A is arranged to have a width somewhat smaller than an outer diameter of the core conductor wire 51 in order to maintain a good condition for electrical connection with the core conductor wire 51.

The press-connecting contacts 30 are individually separated from the common member B, and when the second housing part 20 is molded, each press-connecting contact 30 is partially sealed in the second housing part 20.

Figure 17:
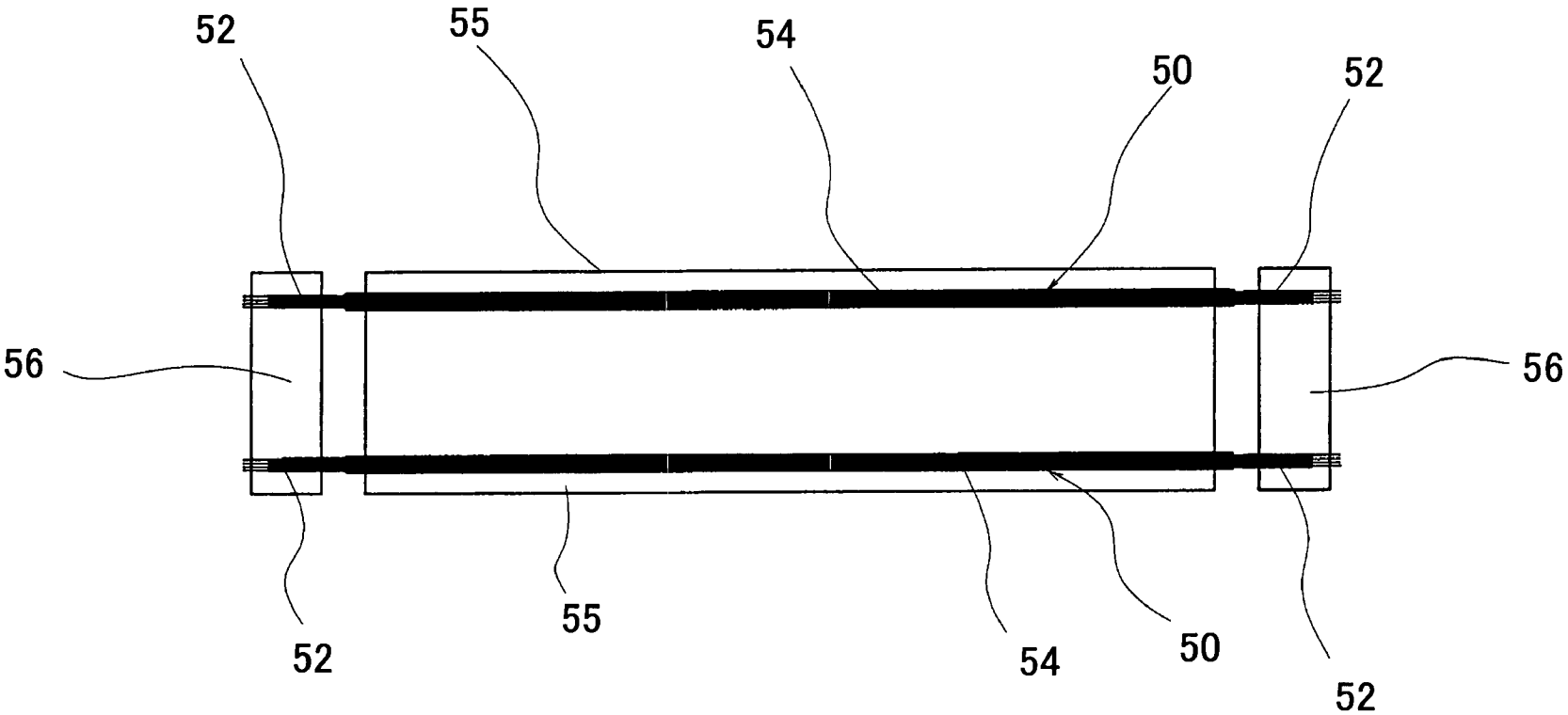
FIG. 17 is a plane view showing a plurality of coaxial cables which have been laminated and bundled into a wire harness form at predetermined intervals H.
Figure 18:
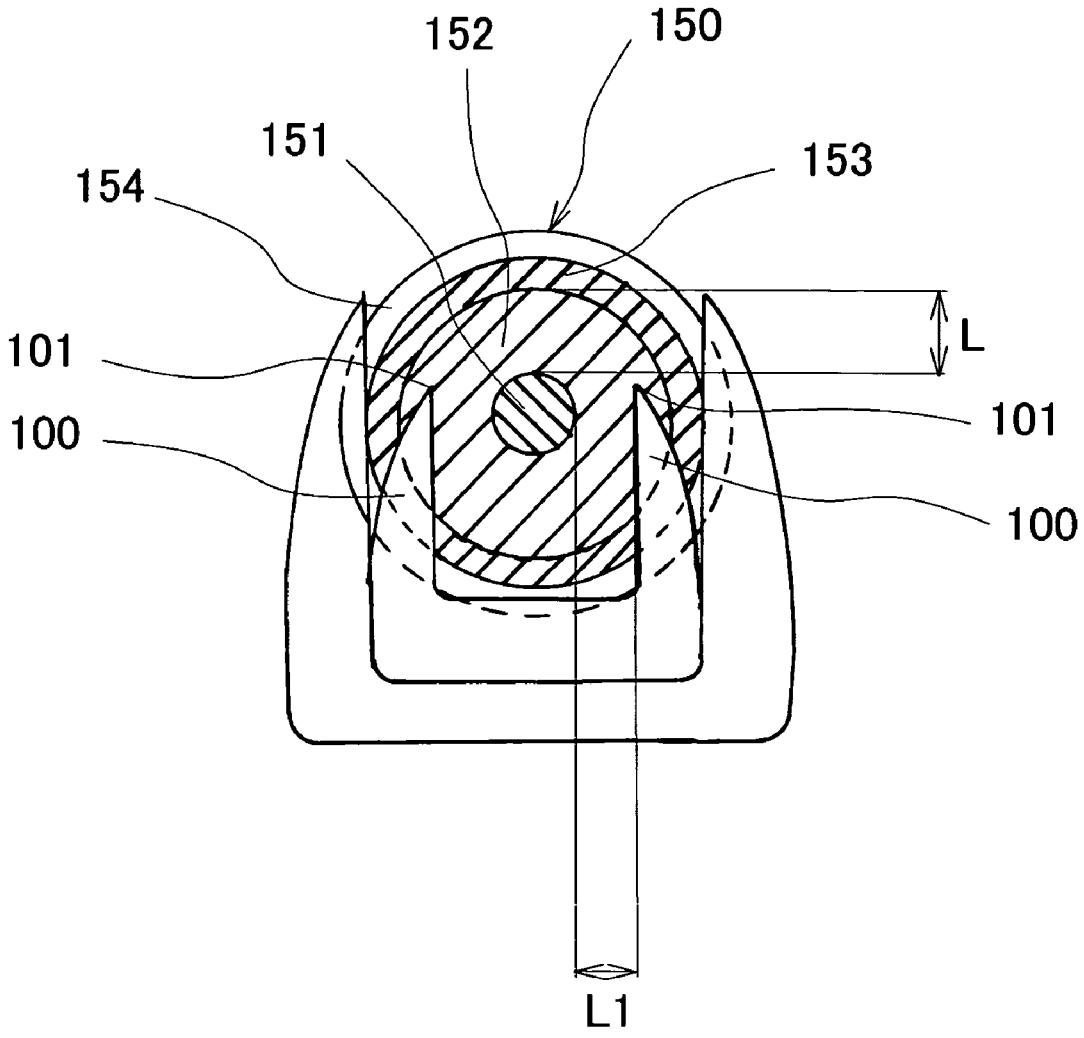
FIG. 18 is a view of assistance in explaining the reference cited 3 (JP-A-2001-223039).

Connection between Piercing Terminal and Coaxial Cable and its Effect and Advantage The structures of the piercing terminal 1, first and second housing parts 10, 20, ground terminal 40, and press-connecting contact 30 and the procedures to assemble them have been described above in reference to FIGS. 1–16B. Now, the connection between each piercing terminal 1 and a coaxial cable for providing a plurality of coaxial cables 50 as illustrated in FIG. 17 on the housing (which is composed of the first and second housing parts 10, 20) all at once will be described in more detail below. FIG. 17 is a plane view showing a plurality of coaxial cables 50 which have been laminated with a resin sheet and bundled into a wire harness form at predetermined intervals H.

First, a plurality of coaxial cables 50 are disposed at the predetermined intervals H on the housing. Then, to the central portion 55 of the plurality of coaxial cables 50 is laminated and bundled into a group of coaxial cables, while two end portion 56 of the group of coaxial cables 50 with respect to the central portion 55 are processed and held with a tape after the leading end portions of the cables have been bared so that the inner insulating layer 52 of thin wire portions of the coaxial cables is exposed to the outside.

Then, the grouped coaxial cables 50 illustrated by FIG. 17 are disposed in the cable-receiving grooves 16 of the first housing part 10. After that, the second housing part 20 is pressed against the first housing part 10 from above it in order to force the individually bared inner insulating layer 52 of each coaxial cable 50 into the press-connecting groove 32A of the corresponding press-connecting contact 30 which is integrally fixed to the second housing part 20 and electrically connect the press-connecting contact 30 to the core conductor wire 51 of the coaxial cable 50.

Next, piercing terminals 1 are forced into the horseshoe-shaped terminal-receptacle holes 13 from below the first housing part 10, while the ground terminal 40 is forced into the ground-terminal-receptacle hole 15 from above it.

As described above, each piercing terminal 1 includes a pair of opposed clipping pieces 3, 4 which are arranged in parallel and spaced from each other by a small distance larger than the outer diameter r1 of the core conductor wire 51 and smaller than the outer diameter R2 of the inner insulating layer 52. Each piercing terminal 1 further includes: piercing blades 3A, 4A formed by chamfering the leading end portions of the clipping pieces 3, 4 into tapers; a pair of curved portions 3B, 4B interposed in the respective clipping pieces 3, 4, each of which is shaped into an outwardly convex form extending across the width of the respective clipping pieces 3, 4; a pair of reinforcing ribs 3C shaped into an outwardly-convex form, arrayed in two rows in parallel in a direction of the width of the clipping piece 3, and extending from the curved portion 3B toward the leading and rear ends of the clipping piece 3 with the curved portion 3B interposed between the reinforcing ribs 3C in each row; and a pair of reinforcing ribs 4C shaped into an outwardly-convex form, arrayed in two rows in parallel in a direction of the width of the clipping piece 4, and extending from the curved portion 4B toward the leading and rear ends of the clipping piece 4 with the curved portion 4B interposed between the reinforcing ribs 4C in each row. The portions between reinforcing ribs 3C and between reinforcing ribs 4C will serve as ground-terminal-receiving grooves 3D, 4D.

As described above, FIG. 4 shows the condition where the piercing terminal 1 and the ground terminal 40 have been forced into the housing. When a coaxial cable 50 is put between the first and second housing parts 10, 20 and then the piercing terminal 1 is forced into the first housing part 10 from below it, the piercing blades 3A, 4A of the pair of clipping pieces 3, 4 tear holes in the outer insulating layer 54 and outer conductor-shielding layer 53 of the coaxial cable 50, brush against the periphery of the inner insulating layer 52, again tear holes in the outer conductor-shielding layer 53 and outer insulating layer 54 in this order, and protrude from the coaxial cable outwardly under the pressing force produced by inserting the piercing terminal 1. During this step, the reinforcing function of the reinforcing ribs 3C, 4C prevents the clearance between clipping pieces 3, 4 from outwardly widening, and the inward reduction of the clearance is prevented by making the clipping pieces 3, 4 pinch and hold a protruding portion 43 of the ground terminal 40 forced into the housing from above it. Therefore, the protruding portion 43 is arranged to have a width substantially equal to the clearance between the clipping pieces 3, 4.

The distance h between the clipping pieces 3, 4 is larger than the outer diameter r1 of the core conductor wire 51 and smaller than the outer diameter R2 of the inner insulating layer 52, more specifically the distance h is somewhat smaller than the outer diameter R2 of the inner insulating layer 52. Hence, the clipping pieces 3, 4 can slide between the periphery of the inner insulating layer 52 and the outer conductor-shielding layer 53 while brushing against the periphery of the inner insulating layer 52 and then protrude from the coaxial cable outwardly. This makes it possible to avoid the risk that the clipping pieces 3, 4 may short-circuit with the core conductor wire 51.

Further, in the condition where the piercing terminal 1 is press-connected to a coaxial cable 50, the curved portions 3B, 4B are located on the periphery the coaxial cable 50 pinched and hold between the clipping pieces 3, 4, and the center of curvature of the inner diameter of each of the curved portions 3B, 4B shaped into arcs substantially coincides with the center of the coaxial cable 50, and therefore the distance between the outer conductor-shielding layer 53 and core conductor wire 51 of the coaxial cable 50 can be kept substantially constant in a portion of the coaxial cable 50 pinched and held by the clipping pieces 3, 4 as well as in the other portion of the cable. Thus, it becomes possible to minimize changes of impedance between the outer conductor-shielding layer 53 and core conductor wire 51.

In addition, the curved portions 3B, 4B of the pair of opposed clipping pieces 3, 4 are provided so as to lie on the same virtual circle and the outer diameter of the curved portions 3B, 4B located on the same virtual circle substantially coincides in size with the inner diameter of the outer conductor-shielding layer 53 taking the form of a tube in section. Accordingly, it can be expected as an advantage that an area for electrical connection between the outer periphery portions of the curved portions 3B, 4B and inner portions lying on a circle formed by the inner diameter of the outer conductor-shielding layer 53 can be ensured sufficiently.

A piercing terminal for a coaxial cable according to the invention can make the impedance between the core conductor wire of a coaxial cable and the piercing terminal substantially equal to the impedance between the core conductor wire and the outer conductor-shielding layer in the case where the piercing terminal for a cable is connected to the outer conductor-shielding layer of the coaxial cable. The piercing terminal for a coaxial cable can further suppress impedance changes in a portion where the piercing terminal for a cable is electrically connected in comparison with other portions of the cable and as such, the application of the piercing terminal to a connector for electrical connection, which has been increasingly reducing in pitch size in recent years, makes possible to avoid impedance changes caused by the connector in a related electrical circuit.

What is claimed is:

1. A piercing terminal for a coaxial cable including a core conductor wire, an inner insulating layer for covering the core conductor wire, an outer conductor-shielding layer for covering the inner insulating layer, and an outer insulating layer for covering the outer conductor-shielding layer, wherein the piercing terminal is capable of performing a conductive connection with the outer conductor-shielding layer when a piercing blade is embedded in the outer insulating layer to penetrate the outer insulating layer, the piercing terminal comprising:

a pair of clipping pieces being arranged to be opposed to each other in a substantially parallel manner;

the piercing blade being disposed at a leading end of each of said pair of clipping pieces; and a coupling portion being joined to base portions of said pair of clipping pieces for holding said pair of clipping pieces spaced at a predetermined distance apart;

wherein each of said pair of clipping pieces comprises a curved portion which is curved outwardly with respect to the pair of clipping pieces, the curved portion being disposed in a vicinity of the base portion and between the piercing blade and the base portion, wherein the predetermined distance is larger than an outer diameter of the core conductor wire and smaller than an outer diameter of the inner insulating layer, wherein the piercing blade at the leading end of each of said pair of clipping pieces is provided with a sharp edge such that the piercing blade pierces the outer insulating layer, and wherein the respective curved portions of said pair of clipping pieces wrap the inner insulating layer around the outer diameter thereof so as to hold the coaxial cable when said pair of piercing blades pierce the outer insulating layer to penetrate the outer insulating layer and the coaxial cable is pressed down between said pair of clipping pieces with the predetermined distance apart to bring the piercing terminal into a conductive connection with the outer conductor-shielding layer.

2. The piercing terminal according to claim 1, wherein each of said pair of clipping pieces comprises reinforcing ribs extending from said curved portion toward the leading end thereof on an outer surface thereof.

3. The piercing terminal according to claim 1, wherein the edge of each of said piercing blades is provided on an outer side with respect to said pair of clipping pieces along a thickness direction of each clipping piece.

4. The piercing terminal according to claim 2, wherein the edge of each of said piercing blades is provided on an outer side with respect to said pair of clipping pieces along a thickness direction of each clipping piece.

5. The piercing terminal according to claim 1, wherein said curved portions of said pair of clipping pieces hold the coaxial cable together by extending outer surfaces of said curved portions along inside surface of the outer conductor-shielding layer.

6. The piercing terminal according to claim 2, wherein said curved portions of said pair of clipping pieces hold the coaxial cable together by extending outer surfaces of said curved portions along inside surface of the outer conductor-shielding layer.

7. The piercing terminal according to claim 3, wherein said curved portions of said pair of clipping pieces hold the coaxial cable together by extending outer surfaces of said curved portions along inside surface of the outer conductor-shielding layer.

8. The piercing terminal according to claim 4, wherein said curved portions of said pair of clipping pieces hold the coaxial cable together by extending outer surfaces of said curved portions along inside surface of the outer conductor-shielding layer.

* * * * *